US005524404A

United States Patent [19]

Lahaye

[11] Patent Number: 5,524,404

[45] Date of Patent: Jun. 11, 1996

[54] FACADE STRUCTURE

[75] Inventor: Christian J. G. Lahaye, Champagne sur Oise, France

[73] Assignee: General Electric Co., N.Y.

[21] Appl. No.: 299,853

[22] Filed: Sep. 1, 1994

Related U.S. Application Data

[63] Continuation of Ser. No. 890,743, May 28, 1992, abandoned.

[30] Foreign Application Priority Data

Jun. 22, 1991 [EP] European Pat. Off. ..... 91110312

[51] Int. Cl.[6] ..... E06B 3/54

[52] U.S. Cl. ..... 52/235; 52/764; 52/775; 52/780

[58] Field of Search ..... 52/235, 398, 400, 52/403, 401, 397, 764, 775, 779, 780; 49/489.1

[56] References Cited

U.S. PATENT DOCUMENTS

| | | | |
|---|---|---|---|
| 3,694,976 | 10/1972 | Warshaw | 57/403 X |
| 3,893,272 | 7/1975 | Plom | 52/235 |
| 4,092,812 | 6/1978 | Dashner et al. | 52/400 X |
| 5,185,979 | 2/1993 | Azzimonti | 52/235 |

FOREIGN PATENT DOCUMENTS

| | | | |
|---|---|---|---|
| 7507982 | 1/1977 | Netherlands | 52/775 |

*Primary Examiner*—Carl D. Friedman
*Assistant Examiner*—Kien T. Nguyen

[57] ABSTRACT

The invention deals with facade structure comprising supporting profiles and glass panes supported by the supporting profiles, the glass panes being fixed to the supporting profiles by a connecting member, wherein the connecting member comprises a connecting profile made from silicone based heat curable rubber, wherein has been embedded at least one metal insert in such a way, that on opposite sides of the connecting profile parts of the metal insert protrude from the connecting profile, the protruding parts of the metal insert being accommodated in recesses provided in the supporting profile.

5 Claims, 1 Drawing Sheet

FACADE STRUCTURE

This is a continuation of Ser. No. 07/890,743 filed on May 28, 1992 abandoned.

This application claims priority of EPC Application No. 91110312.5 filed Jun. 22, 1991, titled Silicone Gasket With Metal Insert.

The invention relates to a facade structure comprising supporting profiles and glass panes supported by said supporting profiles, said glass panes being fixed to said supporting profiles by means of connect means.

Such facade structures, especially so-called structural glazing structures are generally known.

For mounting a glass pane on metal profiles there is generally used a silicone sealant. However especially on supporting profiles of aluminum the fixing of glass panes on the aluminum profiles is very critical and depends strongly from the nature of the surface of the profile, whereby the nature of the surface of a profile can be different along the lengths of the profile.

In view thereof it has been proposed in DE-A-3633618 to use auxiliary profiles which can be accommodate in corresponding recesses in the supporting profiles of the facade, whereby said profiles and recesses have been shaped in such a way that said auxiliary profiles can not move with respect to the supporting profiles in a direction transverse to their longitudinal length. The silicone sealant or the like for mounting the glass pane has been applied thereby between the outer sides of said auxiliary profiles and the glass pane. Hereby there are used relatively cumbersome auxiliary profiles requiring corresponding cumbersome supporting profiles.

There is a need for a solution, whereby the mounting of glass panes on metal supporting profiles be performed in a simple and effective way without having regard to the nature of the surface of the supporting profile.

In accordance with the invention this can be obtained by a connecting means comprising a connecting profile made from silicone based heat curable rubber wherein is embedded at least one metal insert in such way, that on opposite sides of said connecting profile parts of said metal insert protrude from said connect profile, said protruding parts of the metal insert be accomodated in recesses provided in a supporting profile.

As initially the silicone based heat curable rubber is in a easily deformable state (e.g. liquid) it will quite easy to give said silicone based heat curable rubber the desired shape of the profile while embedding at the same time one or more metal inserts. Then after curing by heating there is obtained a resilient prof wherein the metal insert(s) have been anchored in a secure way. By means of said metal insert(s) the connecting profile can be easily mounted on a supporting profile, whilst the rubber part of the connecting profile can be connected with the glass pane by providing suitable sealant between the rubber part of the profile and the glass pane.

Another possibility is to clamp the glass pane against the supporting profile by means of the resilient rubber part of the connecting profile.

It will be clear, that the structure according to the invention can not be used only in structural glazing structures or the like, however e.g. also for mounting glass panes in window frames or the like.

It is noted that EP-A-0100824 shows a structure for interconnecting two metal plates extending parallel to each other by means of ribs made from insulating material and extending perpendicular to said metal plates. The opposite ends of said ribs have been provided dovetail shaped extensions which are accommodated in recesses provided in thickenings on the metal plates. However said reference does not give any indication wit respect to a solution for solving the above stated problem relating to the mounting of glass panes on a facade structure.

The invention will be further described with reference to the accompanying drawings.

FIG. 1 shows in outline a supporting profile 1, which could be a part of a skeleton of the facade of a building or the like, said skeleton forming part of a structural glazing structure.

Thereby the supporting profile could have any suitable desired shape and generally such supporting profiles are extruded from aluminium. In a structural glazing structure the skeleton made from supporting profiles is destined to support glass panes 2.

According to the invention for connecting the glass panes 2 with the supporting profiles there are used connecting profiles 3.

According to the invention a connecting profile comprises a part 4 made from silicone based heat curable rubber, whereby in said part there has been embedded a metal insert 5.

Figure 2:
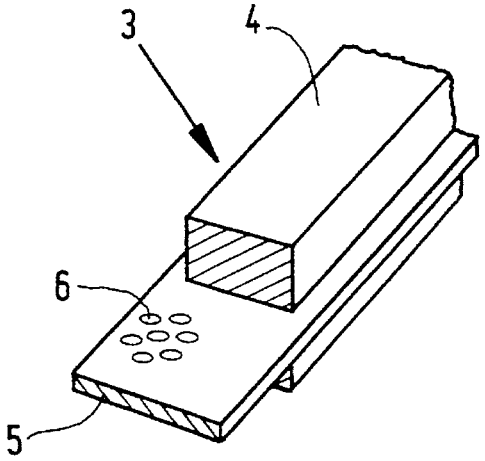
FIG. 2 shows in perspective a part of the connecting profile.

As shown in FIG. 2 the metal insert 5 can extend over the whole length of the connecting profile 3 however it would also be possible to embed in the part various short metal inserts which are spaced from each other when seen in the direction of lengths of the profile 3.

In order to obtain a good connection between the metal insert 5 and the part 4 from heat curable rubber there have been provided holes 6 extending through the metal insert 5, only some of said holes being shown in FIG. 2. The metal insert can have all kind of different shapes (not shown).

Initially the silicone based curable rubber is in a liquid of more or less plastic state, so that the part 4 can be easily formed in the desired shape while at the same time the metal insert(s) 5 is embedded in said liquid or more of less plastic heat curable rubber. Thereafter the heat curable rubber is heated in order to cure said rubber for obtaining the connecting profile from which the part 4 will be resilient.

Figure 1:
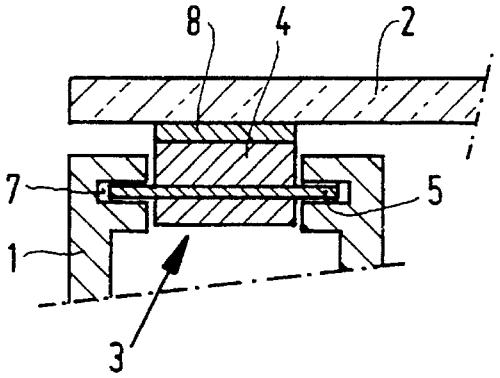
FIG. 1 shows a section through a supporting profile and a connecting profile coupling a glass pane to said supporting profile.

As further appears from FIGS. 1 and 2 the arrangement is so, that on opposite side of the part 4 parts of the insert(s) 5 extend beyond said part 4.

As especially shown in FIG. 1 the supporting profile has been provided with recesses 7 for accomodating the protruding parts from the metal insert(s) 5 with a close fit in order to mount the connecting profile 3 on the supporting profile 1.

Then the glass pane 2 can be connected with the connecting profile 3 by using a sealant 8 suitable for fixing the glass pane 2 to the rubber part 4. While any suitable sealant may be employing, a particularly suitable sealant is a room temperature curable silicone rubber sealant.

In another embodiment (not shown) the rubber part 4 extends over a much smaller width as compared to the configuration shown in FIG. 1. In that case the glass pane 2 can be in direct contact with the rubber part 4 without a sealant 8 in between, whereas the space between the metal insert 5 and the glass pane 2, at the place where there is no rubber part 4, is filled with a sealant.

The connection of the connecting profile 3 to the metal supporting profile 1 by means of a metal insert(s) can be done in a simple, effective and secure way, while also the fixing of a glass pane 2 on a rubber part 4 by means of a sealant 8 can be done in a known, effective and secure way, so that the risks in fixing a glass pane 2 directly on a metal supporting profile are eliminated in a simple and safe way.

It will be clear, that within the scope of the sent invention the supporting profiles as well as the connecting profiles can have other shapes and dimensions.

Figure 3:
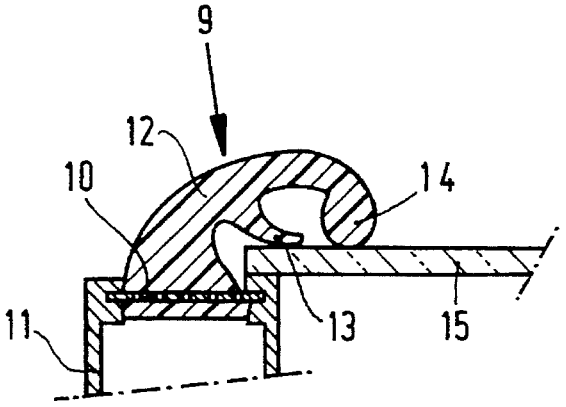
FIG. 3 shows a cross section through a further embodiment of the construction according the present invention.

In FIG. 3 there has been shown a connecting profile 9 provided with a metal insert(s) 10 for connecting profile with a supporting profile 11 in a similar way as described above with respect to the embodiment shown in FIGS. 1 and 2.

As appears from FIG. 3 the part 12 of the connecting profile made from silicone based heat curable rubber has a bend shape with tongues 13, 14 near its free end. The edge of a glass pane 15 has been clamped between an end of the supporting profile 11 and said tongues 13, 14, whereby the glass pane 15 is held in said position by means of the resiliency of the part 1 of the connecting profile 9.

What is claimed is:

1. A facade structure comprising a supporting profile and a glass pane supported by said supporting profile, said glass pane being fixed to said supporting profile but not in contact with said supporting profile by means of a connecting means comprising a silicone based heat curable rubber connecting profile and at least one metal insert imbedded therein whereby on each of opposite sides of said connecting profile, a portion of said metal insert protrudes from said connecting profile, each of said protruding portions of the metal insert being accommodated in recesses in the supporting profile whereby the glass pane is supported on but does not contact the supporting profile.

2. The facade structure according to claim 1 wherein said metal insert has been provided with holes for passing heat curable rubber from one side of the metal insert to the other side.

3. The facade structure according to claim 1 which further comprises a sealant adhering the glass pane to the rubber portion of said connecting profile.

4. The facade structure according to claim 3 in which the sealant is a room temperature curable silicone rubber sealant.

5. A facade structure comprising a supporting profile and a glass pane supported by said supporting profile, said glass pane being fixed to said supporting profile by means of connecting means comprising a silicone based heat curable rubber connecting profile in a bent shape and at least one metal insert imbedded therein whereby, on each of opposite sides of said connecting profile, a portion of said metal insert protrudes from said connecting profile, said protruding portions of the metal insert being accommodated in recesses in the supporting profile and said connecting profile having a free end with a plurality of tongues near its free end whereby the tongues clamp the pane of glass to said supporting profile.

* * * * *